US006718733B2

(12) United States Patent
Kilmartin

(10) Patent No.: US 6,718,733 B2
(45) Date of Patent: Apr. 13, 2004

(54) WINE AND SPIRITS BOTTLE CARRY-OUT PACKAGE WITH ADVERTISING

(76) Inventor: Tracy Marie Kilmartin, 23 Catoonah St., Ridgefield, CT (US) 06877

( * ) Notice: Subject to any disclaimer, the term of this patent is extended or adjusted under 35 U.S.C. 154(b) by 17 days.

(21) Appl. No.: 10/025,738

(22) Filed: Dec. 19, 2001

(65) Prior Publication Data

US 2003/0111375 A1 Jun. 19, 2003

(51) Int. Cl.[7] ..... B65B 21/24; B65B 29/00

(52) U.S. Cl. ..... 53/397; 53/585; 53/472; 53/49; 215/11.6; 215/386; D9/442; D9/444

(58) Field of Search ..... 53/397, 585, 410, 53/411, 415, 420, 472, 128.1, 131.2, 131.3, 135.1, 136.1, 139.5, 49, 142, 390; 206/459.5, 592, 467, 831; 40/310; 229/89–91; 215/386, 11.6; 150/901; 220/903; D9/442, 444; D7/624.2

(56) References Cited

U.S. PATENT DOCUMENTS

| | | | | | |
|---|---|---|---|---|---|
| 217,559 | A | * | 7/1879 | Swope | 229/90 |
| 228,002 | A | * | 5/1880 | Swope | 229/89 |
| 801,524 | A | * | 10/1905 | Hinde | 229/90 |
| 1,473,313 | A | | 11/1923 | Piatt | |
| 1,536,445 | A | | 5/1925 | Maupai | |
| 1,632,347 | A | * | 6/1927 | Pipkin | 40/310 |
| 1,847,277 | A | * | 3/1932 | Stephens | 229/89 |
| 1,999,011 | A | | 4/1935 | Wasser | |
| 2,081,409 | A | * | 5/1937 | Rush | 229/89 |
| 2,132,236 | A | | 10/1938 | Greene | |
| 2,300,473 | A | * | 11/1942 | Van Winkle | 229/93 |
| 2,341,570 | A | * | 2/1944 | Reachi | 206/168 |
| 3,374,298 | A | * | 3/1968 | Studen | 215/395 |
| 3,813,801 | A | * | 6/1974 | Vander Schaaf | 206/459.5 |
| D254,226 | S | | 2/1980 | Morse | |
| 4,208,819 | A | | 6/1980 | Jones et al. | |
| 4,514,995 | A | * | 5/1985 | Curtis et al. | 215/395 |
| 5,102,036 | A | * | 4/1992 | Orr et al. | 229/89 |
| 5,289,650 | A | | 3/1994 | Follett et al. | |
| 5,362,561 | A | | 11/1994 | Lower | |
| 5,581,921 | A | | 12/1996 | Butchens | |
| D403,209 | S | | 12/1998 | Zigterman | |

* cited by examiner

*Primary Examiner*—Stephen F. Gerrity
(74) *Attorney, Agent, or Firm*—St. Onge Steward Johnston & Reens LLC

(57) ABSTRACT

A bottle packaging sleeve, and method of using same, for placing advertising on wine and spirits bottles, which provides both advertising and a way to protect the bottles from damage in a shopping bag or box, comprising a sheet of cushioning material, the exterior face of which is provided with informational material, the sheet being sufficiently elastic to be fitted onto a bottle. Optionally, the sleeve includes a bottle girth adaptor for coupling a first and second end of the sheet of cushioning material while further adapting to the girth of the bottle.

7 Claims, 4 Drawing Sheets

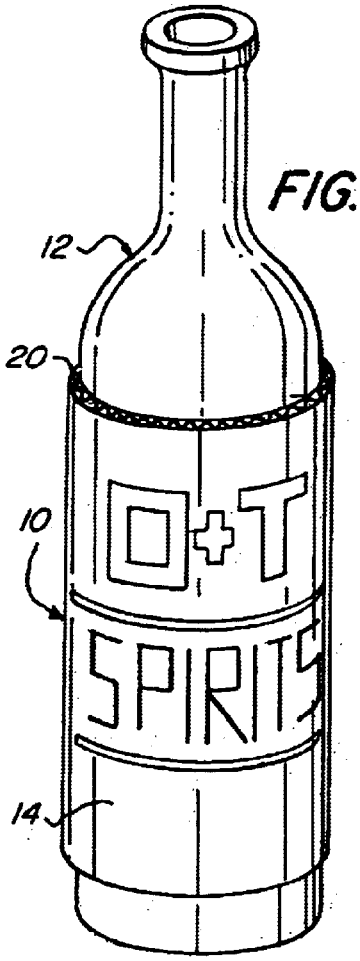
FIG. 1
FIG. 2
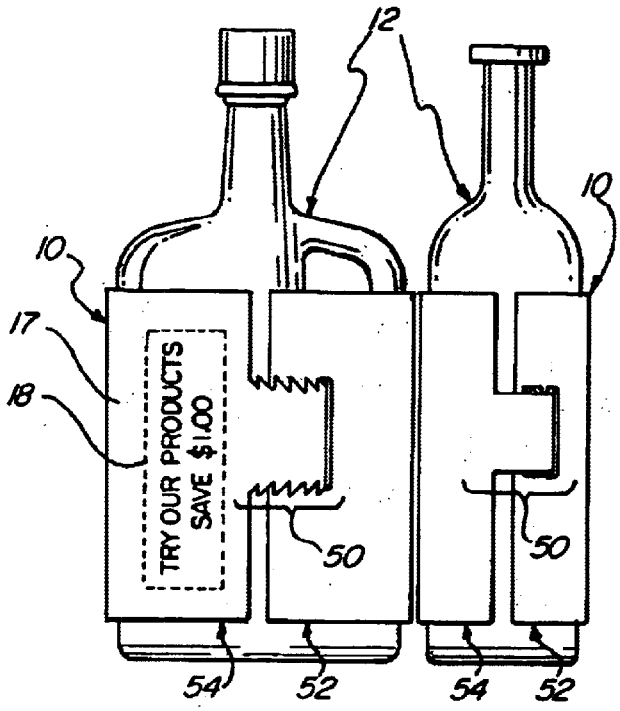
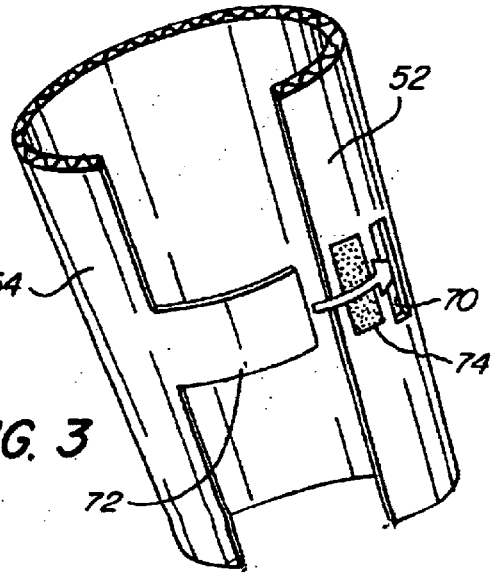
FIG. 3
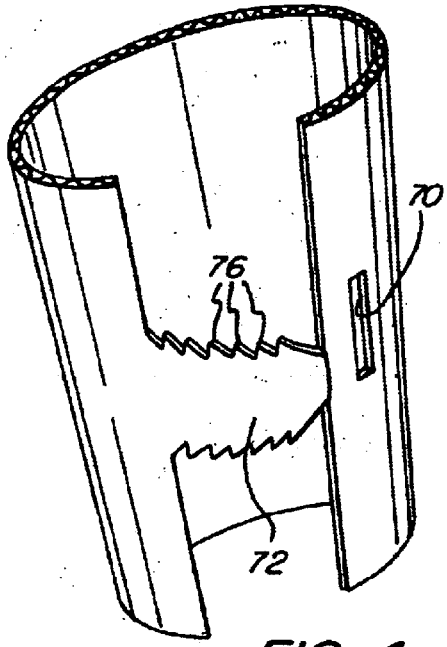
FIG. 4

WINE AND SPIRITS BOTTLE CARRY-OUT PACKAGE WITH ADVERTISING

FIELD OF THE INVENTION

The present invention relates to a method and apparatus for placing advertising on wine and spirits bottles, which provides both advertising and a means to protect the bottles from damage in a shopping bag or box.

BACKGROUND OF THE INVENTION

The use of bottle advertisers has long been recognized. As a result, various inventions have been developed to effect this practice. Some of these include: U.S. Pat. No. 5,289,650 to Follett; U.S. Pat. No. 4,208,819 to Jones; U.S. Pat. No. 2,132,236 to Greene; U.S. Pat. No. 1,999,011 to Wasser; U.S. Pat. No. 1,536,445 to Maupai; and U.S. Pat. No. 1,473,313 to Piatt.

Prior art bottle advertisers have all been adapted for mounting on the bottle when it is stocked on a store shelf. Since these advertising devices are designed for mounting to a bottle prior to sale, they are limited in their advertising space because it is not desirable to obscure the label of the bottle with the advertising device. Therefore, these bottle advertisers are designed to fit on the neck of a bottle. Consequently, advertisers have a limited amount of space upon which to place advertising material. Efforts to increase the amount of advertising space have resulted in the invention of devices that are less easily manufactured or assembled, or which require more room for shipping or storage.

A more desirable bottle advertiser would be one that can be easily and quickly attached to a bottle at the point of sale. Since such an advertiser could be utilized after a consumer has purchased the bottle, and obscuring the label is therefore no longer of any concern, the advertiser can be designed to surround the base of the bottle. Such an advertiser would serve the purpose of providing more space upon which to place advertising material, but also serve the practical purpose of protecting bottles from one another, thereby preventing breakage, chafing, and noise, which can often result from the presence of multiple bottles in a single bag or box.

Accordingly, it is an object of the present invention to create a bottle advertiser that encircles the base of a bottle, thereby providing more space upon which to place advertising material. It is a further object of the present invention to take advantage of the location of the bottle advertiser to also employ it as a device for protecting bottles from one another. Because such an advertiser may obscure labels on the bottle, it is yet another object of the present invention to create an advertiser that is easy to assemble or adjust to the size of the bottle at the point of sale of the bottle.

SUMMARY OF THE INVENTION

The invention relates to a bottle packaging sleeve comprising a sheet of cushioning material having a first and second sheet end couplable to each other, and an interior face and an exterior face, the exterior face having at least a portion thereof provided with informational material, the sheet being sufficiently elastic to be fitted onto a bottle.

The sheet may be an expandable material, which may be fashioned from a corrugated paper or plastic material. The corrugated material may have a facing portion located over a furrowed portion, where at least one section of the facing portion has been removed or at least one slit has been cut in the facing portion. Alternatively, the expandable material may be fashioned from a perforated material or a calendered material. Additionally, the interior face of the sheet may be coated with a friction enhancing coating. The sheet may be generally circular in cross-section and fittable onto a cylindrical bottle.

In some embodiments, the first and second sheet ends may be coupled to each other by a bottle girth adaptor. The bottle girth adaptor can be a tab having two tab portions, where one tab portion is coupled to the other tab portion via incremental, detachable adhesive sections. Alternatively, the bottle girth adaptor can be a tab formed at the first sheet end and a slot formed at the second sheet end, where the tab is secured in the slot by an adhesive or a plurality of barbs on the tab. Alternatively, the bottle girth adaptor can be a section of adhesive located on the first sheet end, the second sheet end, or both.

The invention also relates to a method of situating advertising material on a bottle comprising sliding the above-described bottle packaging sleeve onto a bottle. The invention may also include the step of adjusting the sleeve to the size of the bottle by employing a bottle girth adaptor, where the step of employing the adaptor may be detaching incremental adhesive sections until the sleeve slides around the base of the bottle.

The invention also relates to a method of mounting advertising material on a bottle comprising wrapping around a bottle the above-described bottle packaging sleeve. The invention may also include the step of adjusting the sleeve to the size of the bottle by employing a bottle girth adaptor. The step of employing a bottle girth adaptor may comprise sliding a tab into a slot and securing the tab in the slot with adhesive or a plurality of barbs on the tab.
Alternatively, the step of employing a bottle girth adaptor may comprise securing an extension of the first sheet end to an extension of the second sheet end with an adhesive.

The invention also relates to a method of advertising comprising the steps of fabricating bottle sleeves that each have an exterior face, imprinting advertising information on the exterior faces, distributing the bottle sleeves to retail outlets licensed to sell bottles of wine or liquor, or to merchandising companies, and employees of the retail outlets mounting the bottle sleeves to bottles of wine or liquor sold by the retail outlets at the time of packaging individual bottles for taking by a purchaser, or employees of merchandising companies mounting the bottle sleeves to bottles of wine or liquor when merchandising the bottles.

BRIEF DESCRIPTION OF THE DRAWINGS

FIG. 1 is a perspective view of the bottle packaging sleeve mounted on a bottle.

FIG. 2 is a side view of two bottle packaging sleeves mounted on two different sized bottles and employing two different bottle girth adaptors.

FIG. 3 is a perspective view of a tab-in-slot-with-adhesive bottle girth adaptor.

FIG. 4 is a perspective view of a tab-in-slot-with-barbs bottle girth adaptor.

DETAILED DESCRIPTION OF THE INVENTION

Referring to FIG. 1, a typical embodiment of the present invention takes the form of a bottle packaging sleeve 10 with a generally circular cross-section that fits around the body of a wine or spirits bottle 12. However, as shown in FIG. 2, the sleeve 10 may have any shape suitable for fitting to a wine or spirits bottle 12.

Figure 8:
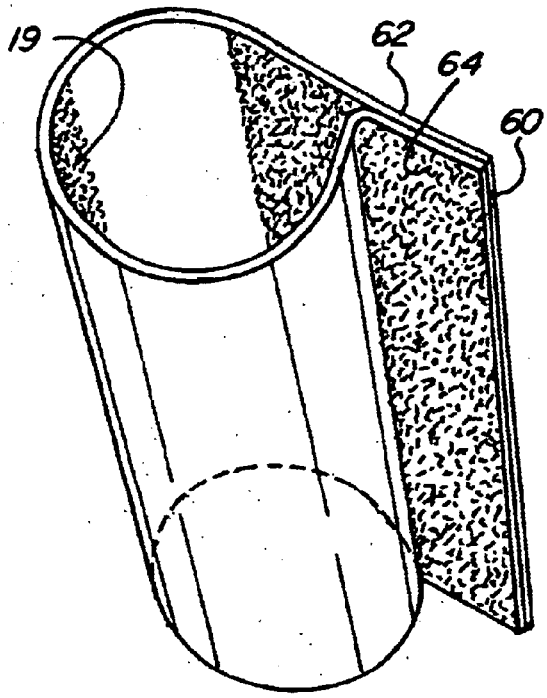
FIG. 8 is a perspective view of an incrementally-releasing-adhesive bottle girth adaptor, where the adaptor forms an outer tab.
Figure 14:
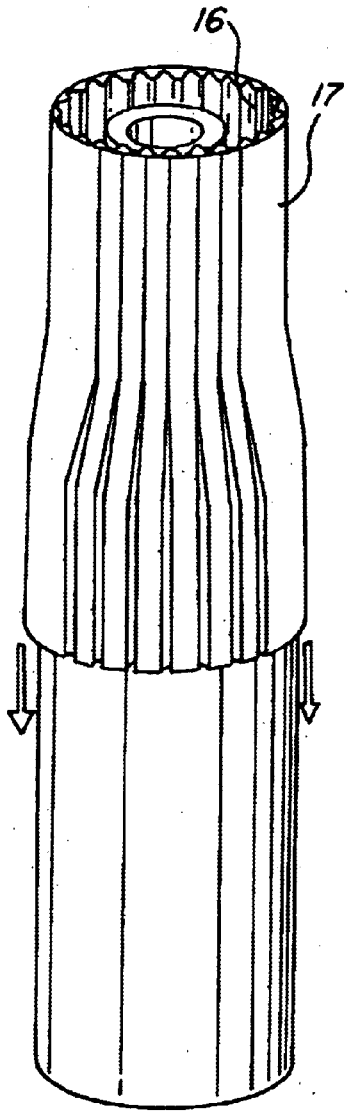
FIG. 14 is a perspective view of the sleeve of FIG. 13 being mounted on a bottle.

As shown in FIGS. 1 and 2, the invention may be an open or closed loop sleeve 10 fashioned from a sheet of cushioning material 14. As shown in FIG. 14, the sleeve has an interior face 16 and an exterior face 17. Referring to FIG. 2, the exterior face 17 is provided with informational material 18. Optionally, and as shown in FIG. 8, the interior face is provided with a friction enhancing coating 19 to reduce slippage of the sleeve 10 on the bottle 12.

Figure 9:
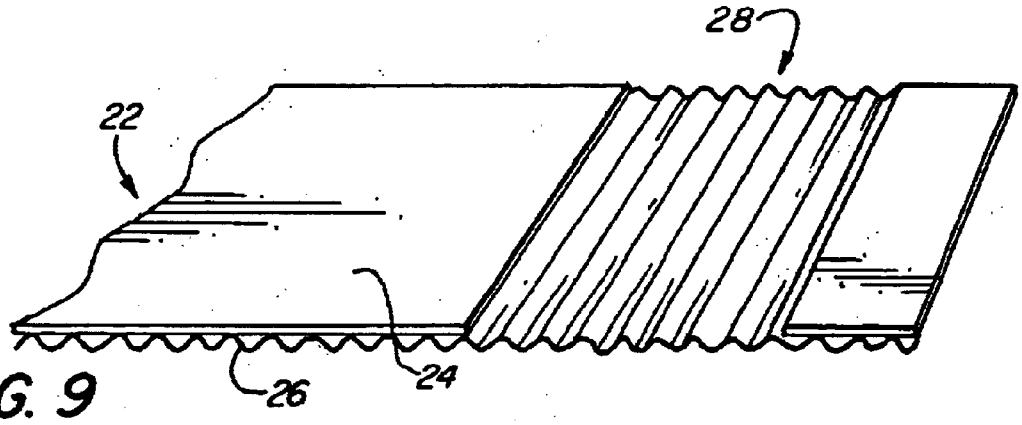
FIG. 9 illustrates an expandable material created by removing a section of the facing portion of a corrugated material.
Figure 10:
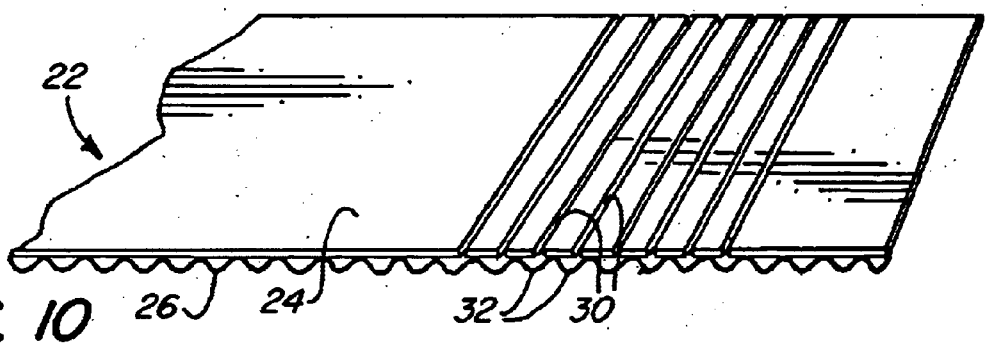
FIG. 10 illustrates an expandable material created by cutting slits in a section of the facing portion of a corrugated material.
Figure 11:
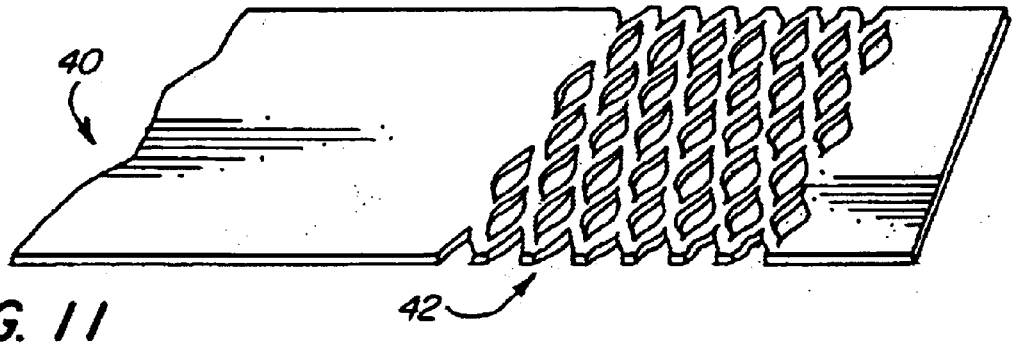
FIG. 11 illustrates an expandable material created by perforating the material.
Figure 12:
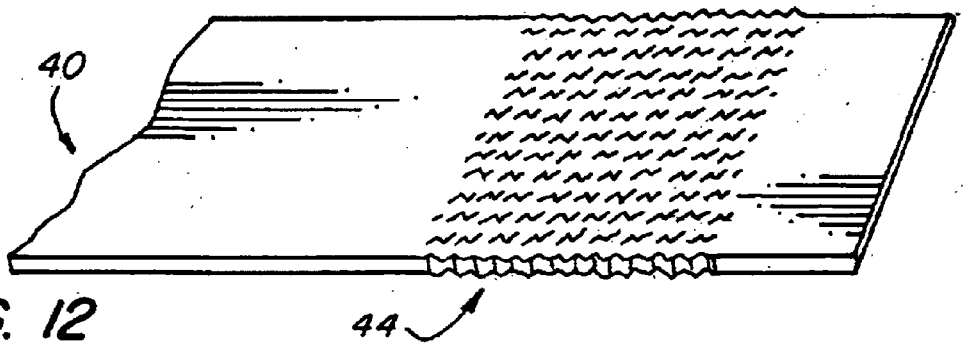
FIG. 12 illustrates an expandable material created by calendering a material.
Figure 13:
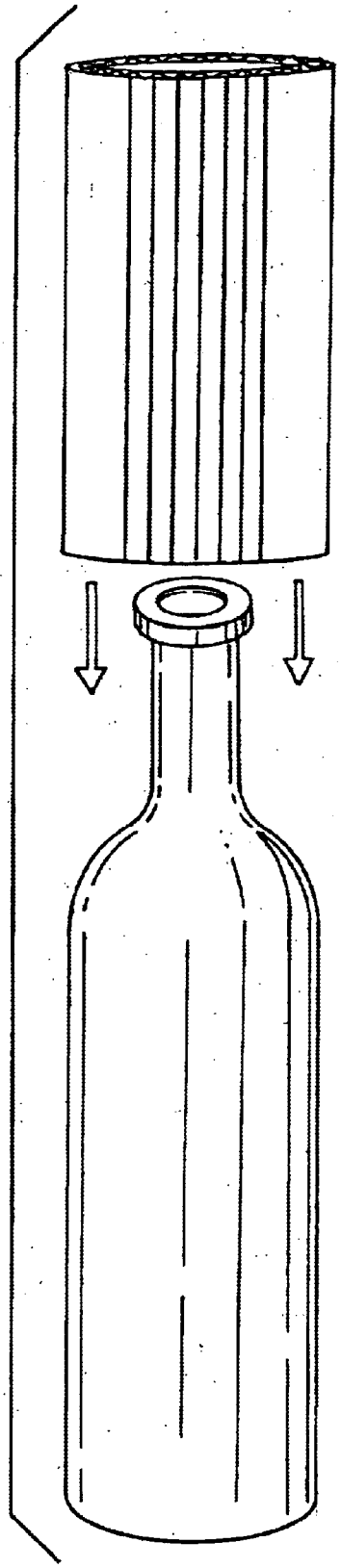
FIG. 13 is a perspective view of a bottle packaging sleeve fashioned from a facing-slitted corrugated material immediately prior to mounting on a bottle.
Figure 15:
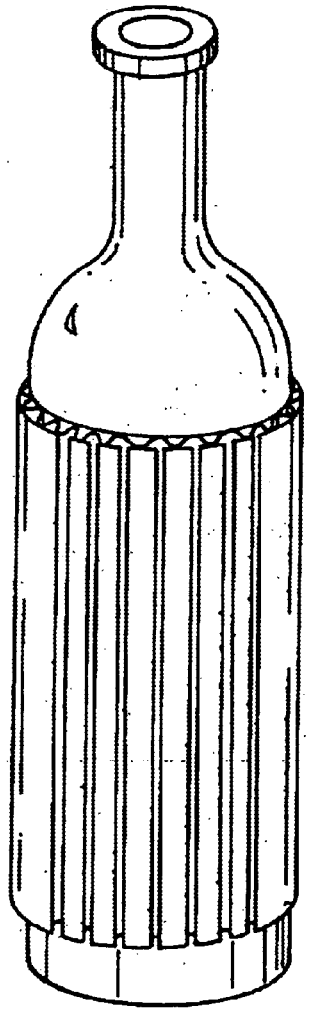
FIG. 15 is a perspective view of the sleeve of FIG. 13 after it has been successfully mounted on a bottle.

Returning to FIG. 1, the sleeve 10 may be an expandable material 20 that enables the sleeve 10 to adjust to the size of the bottle 12 as it is slid thereon, as illustrated in FIGS. 13–15. As shown in FIGS. 9 and 10, the expandable material may be a corrugated paper or plastic material 22. One embodiment that would greater increase elasticity, as shown in FIG. 9, would be a corrugated paper or plastic material 22 that contains at least one facing portion 24 and at least one furrowed portion 26, where at least one section 28 of the facing portion 24 has been removed. Alternatively, and as shown in FIG. 10, a slit 30 may be cut over at least one furrow 32, and preferably, a slit 30 is cut over each of a plurality of furrows 32. In another embodiment, and as shown in FIG. 11, the expandable material be a material 40 that has a section 42 that has been perforated. In yet another embodiment, and as shown in FIG. 12, the expandable material may be a material 40 that has a section 44 that has been calendered.

It should be understood, however, that these embodiments of the expandable material are illustrative, not exclusive or exhaustive, and that the expandable material may be fashioned from any other material sufficiently elastic to permit the sleeve 10 to be fitted onto a bottle 12.

As shown in FIG. 2, the invention may be further adjustable to the size of the bottle 12 by having a bottle girth adaptor 50, which couples a first sheet end 52 to a second sheet end 54 of the sheet of cushioning material 14.

Figure 6:
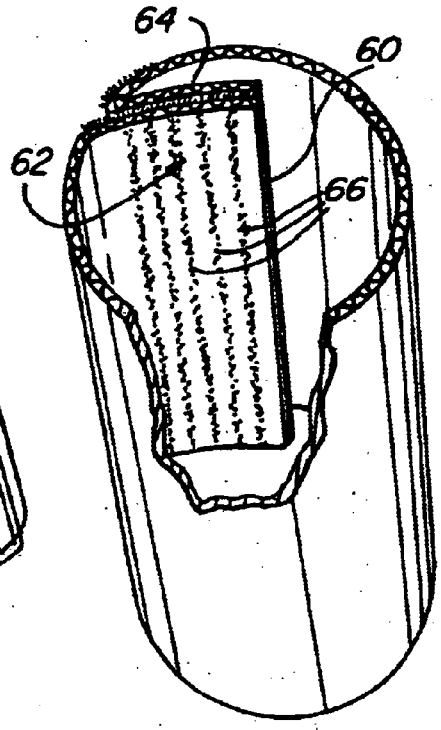
FIG. 6 is a perspective view of an incrementally-releasing-adhesive bottle girth adaptor, where the adaptor forms an inner tab.
Figure 7:
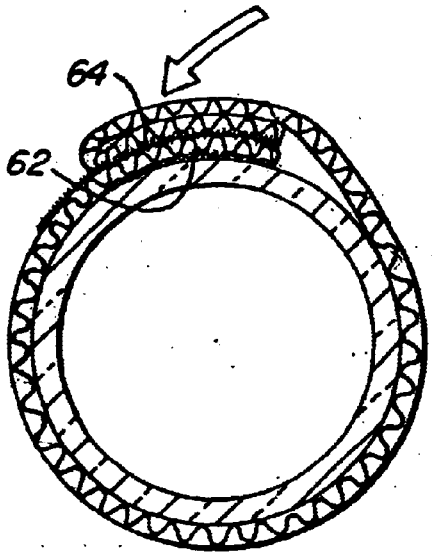
FIG. 7 is a cross-sectional view of an incrementally-releasing-adhesive bottle girth adaptor, where the adaptor forms an inner tab.

The bottle girth adaptor 50 may be in the form of a detaching mechanism. For example, as shown in FIGS. 6–8, the adaptor may be a tab 60 having a first tab portion 62 and a second tab portion 64 which are coupled to each other by incremental adhesive sections 66, which may be incrementally detached. The tab may be formed as an inner tab, as shown in FIGS. 6–7, or as an outer tab, as shown in FIG. 8.

Figure 5:
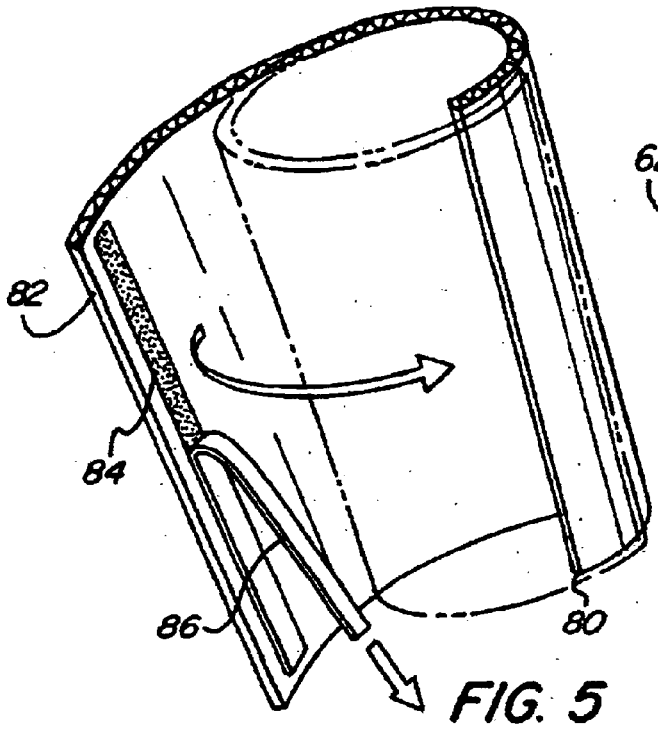
FIG. 5 is a perspective view of an adhesive bottle girth adaptor.

Alternatively, the bottle girth adaptor 50 may be in the form of an attaching mechanism. For example, the adaptor may be one of various tab-in-slot varieties. One such embodiment, as shown in FIG. 3, may be a slot 70 cut in the first sheet end 52, and a tab 72 located at the second sheet end 54, sized to fit through the slot 70. An adhesive 74, located on the tab 72, near the slot 70, or both, may serve to secure the tab 72 in the slot 70. Alternatively, as shown in FIG. 4, the tab 72 may have a plurality of barbs 76 that serve to secure the tab 72 in the slot 70. As shown in FIG. 5, yet another embodiment of an attaching mechanism would be an extension 80 of the first sheet end 52, an extension 82 of the second sheet end 54, and an adhesive 84 located on the extension 82 of the second sheet end for securing it to the extension 80 of the first sheet end. This adhesive may be of the peel-and-stick variety, having a removable strip 86 that the user peels off to expose the adhesive 84. Alternatively, the adhesive may serve as a means to secure the sheet of cushioning material 14 to another sheet of cushioning material 14 where, prior to each sheet having its extension 80 connected to its extension 82, a series of such sheets are connected in a roll or strip, each of which can be individually detached from the roll or strip, and the adhesive can be reused to connect the sheet's extension 80 to its extension 82 after detachment from the roll or strip.

It should be understood, however, that these embodiments of the bottle girth adaptor are illustrative, not exclusive or exhaustive, and that the adaptor may be in the form of any other attaching or detaching mechanism suitable for coupling the first sheet end 52 to the second sheet end 54 of the sheet of cushioning material 14 while also adjusting for the girth of the bottle 12.

The method of advertising of the invention using the above described embodiments of the bottle advertiser comprises the steps of: fabricating bottle sleeves that have an exterior face and imprinting advertising information on the exterior faces. The bottle sleeves are then distributed through distributors and merchandising companies, or directly, to retail outlets licensed to sell bottles of wine or liquor. Employees of the retail outlets then mount the bottle sleeves to bottles of wine or liquor sold by the retail outlets, typically at the time of packaging individual bottles for taking by a purchaser. (In this application, the term "employees of the retail outlets" is intended to encompass all personnel working on site, and includes store employees, independent contractors, employees or independent contractors of merchandising companies, etc.).

In some cases, where display bottles may be displayed adjacent to or separately from inventory bottles, the bottle sleeves may be pre-mounted to the inventory bottles where convenient and consistent with the product marketing at the particular retail outlet. In such cases, the mounting may be done at the retail outlet, or even by manufacturers or distributors, prior to delivery of the bottles to retail outlet. However, it is expected that this will not be the preferred method of the invention, as consumers typically prefer to select a bottle off the shelf without any cluttering packaging or information.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practioners in the art who are not familiar with the patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed is:

1. A method of situating advertising material on a bottle comprising the steps of:

sliding onto a bottle a circular sleeve comprising a sheet of cushioning material having an interior face and an exterior face, which exterior face includes advertising information;

adjusting said sleeve to the size of said bottle by employing a bottle girth adaptor;

wherein said adaptor comprises a tab, which tab comprises a first tab portion and a second tab portion;

said first tab portion has incremental adhesive sections by which said first tab portion is coupled to said second tab portion; and the step of employing a bottle girth adaptor comprises detaching said incremental adhesive sections until said sleeve slides around the base of said bottle.

2. A method of advertising, comprising the steps of:

fabricating bottle sleeves, each having an exterior face;

imprinting advertising information on the exterior faces of said bottle sleeves;

distributing said bottle sleeves to retail outlets licensed to sell bottles of wine or liquor;

employees of said retail outlets mounting said bottle sleeves to bottles of wine or liquor sold by said retail outlets, at the time of packaging individual bottles for taking by a purchaser of such bottles of wine or liquor.

3. A method in accordance with claim 2, wherein said bottle sleeves comprise a cushioning material.

4. A method in accordance with claim 3 wherein said cushioning material comprises a corrugated paper or plastic material.

5. A method of advertising, comprising the steps of:

fabricating bottle sleeves, each having an exterior face;

imprinting advertising information on the exterior faces of said bottle sleeves;

distributing said bottle sleeves to manufacturers, distributors, or retailers of bottles of wine or liquor;

employees of said manufacturers, distributors, or retailers mounting said bottle sleeves to bottles of wine or liquor sold by said manufacturers, distributors, or retailers, either at the time of packaging individual bottles for taking by a purchaser of such bottles of wine or liquor or to bottles of wine or liquor held in inventory but not for display.

6. A method in accordance with claim 5, wherein said bottle sleeves comprise a cushioning material.

7. A method in accordance with claim 6 wherein said cushioning material comprises a corrugated paper or plastic material.

* * * * *